United States Patent [19]

Lilyquist

[11] 3,988,343

[45] Oct. 26, 1976

[54] COATING COMPOSITION FOR NON-WOVEN FABRICS

[75] Inventor: Marvin R. Lilyquist, Raleigh, N.C.

[73] Assignee: Monsanto Company, St. Louis, Mo.

[22] Filed: Dec. 31, 1974

[21] Appl. No.: 537,749

[52] U.S. Cl. ..... 260/29.6 MM; 106/308 M; 260/29.6 MN; 283/21; 428/267; 428/296; 428/474

[51] Int. Cl.[2] ..... C08L 33/04

[58] Field of Search ..... 260/29.6 MM, 29.6 MN; 428/267, 296, 474, 290; 106/308 M; 283/21

[56] References Cited

UNITED STATES PATENTS

| | | | |
|---|---|---|---|
| 3,175,988 | 3/1965 | Berns | 260/29.6 MN |
| 3,484,260 | 12/1969 | Emslie et al. | 260/29.6 MN |
| 3,666,680 | 5/1972 | Briggs | 260/29.6 MN |
| 3,674,726 | 7/1972 | Kirk | 260/29.6 MN |

OTHER PUBLICATIONS

Color Index, vol. 3, 1972, pp. 3338–3339.

*Primary Examiner*—M. J. Welsh
*Attorney, Agent, or Firm*—Russell E. Weinkauf

[57] ABSTRACT

A coating composition is provided for application to substrates of autogenously bonded, non-woven nylon fabrics in order to render these fabrics suitable for use as a label print stock in the production of durable labels for wearing apparel. The coated nylon fabric is resistant to abrasion, laundering and dry-cleaning. It also accepts printing inks with good print register without running or fading.

2 Claims, No Drawings

COATING COMPOSITION FOR NON-WOVEN FABRICS

This invention relates generally to a composition for coating non-woven fabrics. More particularly, the invention is directed to a composition for coating autogenously bonded, non-woven, nylon fabrics to render these materials highly suitable for use in the production of durable labels for wearing apparel.

Under recent government regulations, the care labeling of wearing apparel has become mandatory. The regulations require that any and all articles of wearing apparel, or textile piece goods sold primarily for conversion of a finished article of wearing apparel, must contain a label which clearly discloses instructions for the care and maintenance of such goods. The label must be permanently affixed to the article and must remain legible for the normal life of the article.

As a result of these requirements, there has been an industrywide search for a low-cost label print stock which would be durable to a large number of laundering or dry cleaning cycles; and which would retain printing inks in legible condition for the useful life of apparel goods.

It has now been found that a label print stock which fully meets the afore-noted requirements may be produced by coating an autogenously bonded, non-woven, nylon fabric with a coating composition whose essential components include: a heat and abrasion resistant acrylic latex binder, a titanium dioxide pigment to provide opacity and whiteness, tinting pigments to enhance whiteness and to mask the yellowing effects of heat and laundry agents, and an optical brightening agent to enhance the brightness of the coated product.

The autogenously bonded, non-woven, nylon fabrics which are used as a substrate to which the coating is applied are well-known textile products and find application in a wide variety of end-uses. They are obtained by continuous processing methods in which freshly spun filaments are attenuated by an air-jet and then collected on a moving lay-down surface in the form of a web. The filaments, which are randomly distributed throughout the web, are then autogenously bonded together at their cross-over points by a procedure which involves the absorption and desorption of an activating gas such as, for example, hydrogen chloride. For a more detailed description of these nonwoven fabrics and the methods by which they are produced, reference may be had to U.S. Pat. Nos. 3,542,615; 3,516,900; 3,556,895 and 3,676,244.

The coating as contemplated by this invention is comprised of the following uniquely balanced composition:

a. from about 200 to 400 parts by weight of an acrylic polymer latex having a solids content of from about 45 to 60 percent by weight;

b. from about 200 to 400 parts by weight of an aqueous dispersion of a titanium dioxide pigment in the anatase form, and wherein the aqueous dispersion has a solids content of from about 45 to 55 percent by weight;

c. from about 0.005 to 0.01 parts by weight of a blue tinting pigment which may be selected from Monastral Blue BT-284D, Color Index No. 74160 or Chromphtal Blue A3R, Color Index No. 69800;

d. from about 0.007 to 0.015 parts by weight of a violet tinting pigment which may be either Platinum Violet BP 273D, Color Index No. 60010 or Ergazine Violet 6RLT; and e. from about 1 to 3 parts by weight of an optical brightener of the stilbene naphthotriazole type.

In a particularly preferred embodiment, the coating composition contains the following:

a. 300 parts by weight of an acrylic polymer latex, wherein the latex has a solids content of about 50 percent by weight;

b. 300 parts by weight of an aqueous dispersion of a titanium dioxide pigment in the anastase form, wherein the aqueous dispersion has a solids content of about 50 percent by weight;

c. 0.0090 parts by weight of a blue tinting pigment consisting of Monoastral Blue BT-284D, Color Index No. 74160;

d. 0.0135 parts by weight of a violet tinting pigment consisting of Platinum Violet BP 273D, Color Index No. 60010; and e. 2.0 parts by weight of an optical brightener of the stibene naphthotriazole type.

The coating may be applied to the non-woven fabric by conventional techniques, for example, the knife-over-roll method or by padding. When employing the knife-over-roll method, it may be desirable to add small amounts of a thickening agent to the coating formulation such as, for example, various salts of carboxylated polyacrylates. After application, the coating is dried and cured to form a continuous solid film that uniformly envelopes the filaments of the non-woven fabric. The drying and curing operations can be conducted separately or concurrently. Generally, both can be accomplished simultaneously by exposing the coated fabric to an oven temperature of from about 250° F. to 350° F. for a period of from about 30 seconds to 5 minutes.

The acrylic polymer latex used as a binder in the coating formulation offers the advantages of a markedly superior heat and color stability when compared with other binder systems. The acrylic polymer is preferably a copolymer such as, for example, the polymer obtained by polymerizing acrylonitrile with a comonomer such as methylacrylate or vinyl acetate. An especially preferred copolymer is one whose major component is ethylacrylate and characterized by infrared absorption peaks at the following frequencies: 295; 303; 340; 585; 695; 733; 870; 980 and 1180 microns. The particle size of the emulsified polymer should be from about 1500 to 2500 angstrom units. The emulsifier for dispersing the polymer in the aqueous latex system is desirably of the synthetic anionic type. Both the acrylic polymer and the emulsifying system should be carefully selected and balanced for maximum stability to heat discoloration.

In preparing the aqueous dispersion of the titanium dioxide pigment for use in the coating composition of this invention, the particle size of the pigment should be less than 0.2 microns and the solids content of the dispersion is desirably between about 45 to 55 percent by weight. As is known, titanium dioxide pigments exist in the anatase form (octahedral crystallized) and the rutile form (tetrahedral crystallized). Evaluations have shown that the anatase form is best suited for the purposes of this invention principally because it imparts a substantially greater whiteness to the coated fabric.

Although a coating composition consisting solely of the aforementioned selective pigment and binder provides a relatively good coating performance, the color stability to heat is not quite adequate for the highest quality label stock for use with white goods. It has been known in the textile and polymer industries that certain tinting pigments can be used effectively to offset or mask a yellowing discoloration. The conventional practice in these industries is to add tinting pigments to the polymer solutions or melts prior to forming useful articles from them; i.e., spinning of synthetic fibers or casting of films. However, it is important for the purposes of this invention that the tinting pigments be added to the coating formulation and not the preformed fabric substrate. In this way, all components of the coating formulation may be adjusted as to give an optimum balance of performance properties to the final coated product. The tinting pigments are generally added to the formulation from a masterbatch in which a quantity of the acrylic polymer latex may be employed as a carrier vehicle. The masterbatch may be prepared by milling the pigments into the carrier with a ball mill attritor. As has been noted, the combination of a blue and violet tinting pigment is employed, with Monastral Blue BT-284D, Color Index No. 74160 and Platinum Violet BP-273D, Color Index No. 60010 being the combination of choice. As described in the "Handbook of Colorimetry" by Arthur C. Hardy and published by the Massachusetts Institute of Technology, Monastral Blue has a dominant wave length of 477 and that of Platinum Violet is 558C.

The optical brightener employed in the durable coating formulation of this invention is of the stilbene napthotriazole class and any such type brightener may be used with satisfactory results. Particularly good results have been obtained with commercially available brighteners manufactured by the Ciba-Geigy Company and sold under the tradenames "Tinopal RBS 200" and "Brightener CHA 1036". The optical brightener may be added to the formulation from a masterbatch consisting of a slurry in hot de-ionized water.

It has been found that the presence of the tinting pigments and the optical brightener in the coating composition contributes substantially to the resistance to laundering of the ultimate label product. That is, the coated non-woven, nylon fabric actually shows an improvement in color (whiteness) after as many as twenty-five washing cycles when these components are present in the coating composition. This is contrary to the expected results based on the performance of the commercially available label materials, and is indicative of the unique advantages of this invention.

In addition to this remarkable resistance to laundering, the coated label stock is resistant to dry-cleaning and accepts printing inks with good print register without running or fading. Moreover, the coated label material has the desirable aesthetic properties (drape, softness, whiteness) of a good woven fabric in addition to the advantages of tear resistance, non-raveling, light weight and low-cost which are contributed by the autogenously bonded, non-woven, nylon fabric.

In the production of the coating composition of this invention various compounding aids, well known in the art may be used to advantage such as, for example; dispersing, thickening and antifoaming agents, Also, an antioxidizing agent may be introduced into the formulation as an optional ingredient to further enhance the protection against the discoloring effects of heat.

I claim:

1. A durable label stock having good resistance to abrasion and cleaning and good acceptance and retention of printing inks, comprising a. an autogenously bonded, nonwoven nylon fabric substrate, and b. a continuous film enveloping the filaments of the nonwoven fabric substrate, said film being made from a composition having 1. about 200 to 400 parts by weight of an acrylic polymer latex having a solids content of from about 45 to 60 weight percent, said polymer solids having a particle size of 1500 to 2500 angstrom units,
2. about 200 to 400 parts by weight of an aqueous dispersion of a titanium dioxide pigment in the anatase form, wherein the aqueous dispersion has a solids content of from about 45 to 55 weight percent, said titanium dioxide pigment having a particle size less than about 0.2 microns,
3. about 0.005 to 0.01 parts by weight of a blue tinting pigment selected from the group consisting of Monastral Blue BT-284D, Color Index No. 74160 and Chromphtal Blue A3R, Color Index No. 69800,
4. about 0.007 to 0.015 parts by weight of a violet tinting pigment selected from the group consisting of Platinum Violet BP 273D, Color Index No. 60010 and Ergazine Violet 6RLT, Pigment Violet No. 30, and
5. about 1 to 3 parts by weight of an optical brightener based on stilbene naphthotriazole.

2. The label stock of claim 1 wherein the film is made from a composition having about 300 parts by weight of the acrylic polymer latex and wherein the latex has a solids content of about 50 weight percent, the composition also containing about 300 parts by weight of the aqueous pigment dispersion.

* * * * *